US006776709B1

(12) United States Patent
Moore, Jr. et al.

(10) Patent No.: US 6,776,709 B1
(45) **Date of Patent: *Aug. 17, 2004**

(54) OPENABLE FLOOR VENT COVER

(75) Inventors: Fred D. Moore, Jr., Horsham, PA (US); Debra Reilly, King of Prussia, PA (US)

(73) Assignee: Comfort Creators, Inc., Collegeville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/385,553

(22) Filed: Mar. 11, 2003

Related U.S. Application Data

(63) Continuation-in-part of application No. 09/910,934, filed on Jul. 24, 2001, now Pat. No. 6,558,248.

(51) Int. Cl.[7] ..... F24F 13/20
(52) U.S. Cl. ..... 454/289; 49/463; 160/106
(58) Field of Search ..... 454/289, 290, 454/370; 49/463; 160/106

(56) References Cited

U.S. PATENT DOCUMENTS

| | | | | |
|---|---|---|---|---|
| 32,897 | A | 7/1861 | Sexton | |
| 684,610 | A | 10/1901 | Marshke | 160/106 |
| 2,069,268 | A | 2/1937 | Otto | 160/106 |
| 2,080,726 | A | 5/1937 | Lowinger | 183/51 |
| 2,203,311 | A | 6/1940 | Sinclair | |
| 2,557,566 | A | 6/1951 | Ronfeldt | 454/276 |
| 2,743,660 | A | 5/1956 | Scherff | |
| 3,603,048 | A | 9/1971 | Hadfield et al. | 16/4 |
| 4,712,343 | A | 12/1987 | Dearing et al. | 454/370 |
| 4,856,493 | A | 8/1989 | Fleming et al. | 126/299 D |
| 5,213,543 | A | 5/1993 | Clarino | 292/253 |
| 5,462,382 | A | 10/1995 | Sauerwein et al. | 404/2 |
| 5,623,795 | A | 4/1997 | Padgett, Jr. | 182/47 |
| 5,720,660 | A | 2/1998 | Benedetto et al. | 454/284 |
| 5,954,221 | A | 9/1999 | Boland | 220/495.08 |
| 5,984,776 | A | 11/1999 | Berger | 454/290 |
| 6,196,597 | B1 | 3/2001 | Karnes | 285/331 |
| 2003/0068972 | A1 | 4/2003 | Snyder | 454/330 |

*Primary Examiner*—Harold Joyce
(74) *Attorney, Agent, or Firm*—Drinker Biddle & Reath

(57) ABSTRACT

An openable floor vent cover for use in preventing debris from entering a floor vent during construction is comprised of a board having a length and width larger than the vent to be covered. Then board is provided with a cut substantially in the shape and size of the vent to be covered. An airflow permable debris barrier is attached to the periphery of a first surface of the board. The portion of the board within the cut is removable to enable airflow from the vent as desired during construction, and may be replaced when airflow from the vent is no longer needed. The board is nailed to the subflooring surrounding the vent. The cover may be removed after construction.

16 Claims, 5 Drawing Sheets

OPENABLE FLOOR VENT COVER

CROSS-REFERENCE TO RELATED APPLICATION

The present application is a continuation-in-part of U.S. patent application Ser. No. 09/910,934, which was filed Jul. 24, 2001 now U.S. Pat. No. 6,558,248.

FIELD OF THE INVENTION

The present invention relates to an apparatus for use during the construction of homes and buildings wherein a floor vent may be covered to prevent debris from entering the vent during construction, but selectively opened to allow the passage of airflow, such as heating or cooling air, as desired during construction.

BACKGROUND OF THE INVENTION

There has been a need in the field of construction to prevent debris from entering floor vents. This debris may be various types of objects including saw dust, small pieces of wood, pieces of dry wall, dirt, nails and various other debris generated during the construction process. This debris falls down into the floor vent and often times ends up in a portion of the duct where it could congest the duct and the floor vent. Such floor vents are difficult to clean out, and are often not adequately cleaned prior to the completion of the construction. Very often, air deflectors are placed over the vents and the debris remains in the vents.

Recently, this problem has been addressed by Karnes in U.S. Pat. No. 6,196,597 B1 wherein Karnes discloses a relatively complicated heating duct structure which includes a floor mounted elbow boot which is equipped with a removable plastic cover to prevent dust, dirt and debris from accumulating in the installed heating duct during finish construction of the building. However, this requires an expensive especially made floor mounted elbow boot which is equipped with this special duct cover. It is only available with the particular duct. It requires the molding of a particular plastic cover to exactly fit the particular duct.

SUMMARY OF THE INVENTION

The present invention provides numerous advantages including the fact that it is a relatively inexpensive item which may be used and disposed of after a single use. However, alternatively, the openable floor vent cover of the present invention may be reused on multiple occasions if so desired.

Briefly and basically, the present invention comprises an apparatus which includes a board having a length and a width larger than the vent to be covered. The board is provided with a first and a second surface with an airflow permeable debris barrier secured to the periphery of the first surface of the board. The board is provided with a cut substantially in the shape and size of the vent to be covered. In use, the periphery of the board with the airflow permeable debris barrier attached thereto is secured to the subfloor surrounding a vent during construction and the portion of the board within the cut is selectively removable to enable airflow from the vent as desired.

In a presently preferred embodiment, the board is made from cardboard and can be provided with a foil covering. However, it is understood that other suitable rigid and semi-rigid materials may be utilized to construct the board including wood or composite manufactured materials. The airflow permeable debris barrier may be stapled to the cardboard, or it may be applied adhesively or by any other type of fastener. According to a unitary embodiment of the present invention, the airflow permeable debris barrier and the board are formed from a single blank, such as a cardboard blank, that is folded in half and the two halves are stapled or otherwise fastened together.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
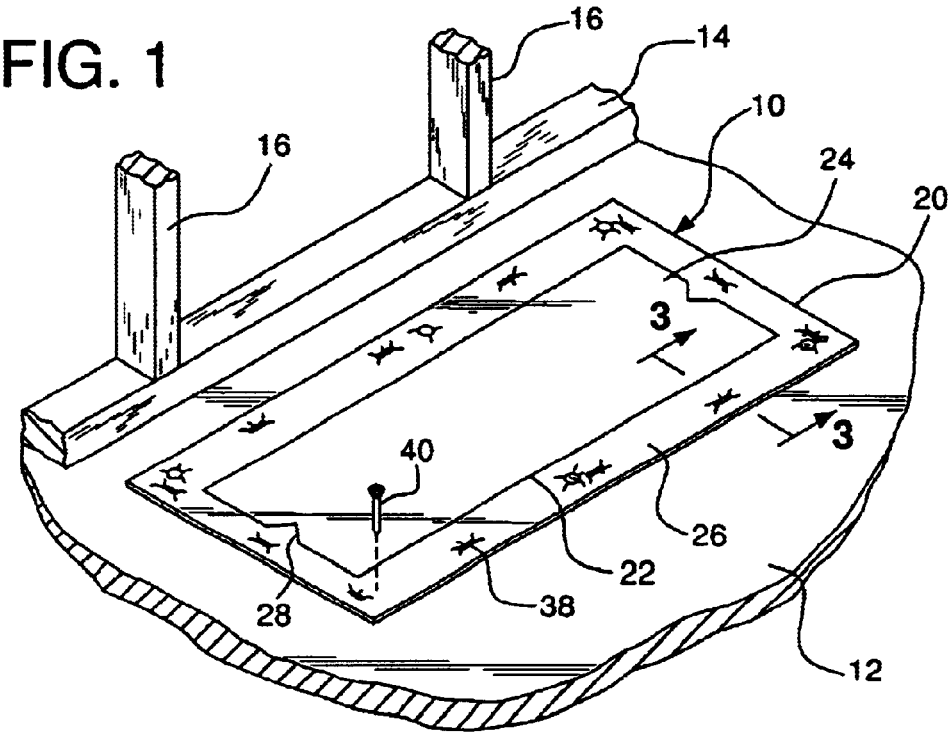
FIG. 1 is a view in perspective of an openable screened floor vent cover in accordance with the present invention being applied over subflooring to cover a vent.

Referring now to the drawings, wherein like numerals indicate like elements, there is shown in FIG. 1 an openable screened floor vent cover 10 in accordance with the present invention applied over the subflooring 12 of a building under construction. A typical base plate 14 and studs 16 are illustrated as a typical environment in which use may occur.

Figure 2:
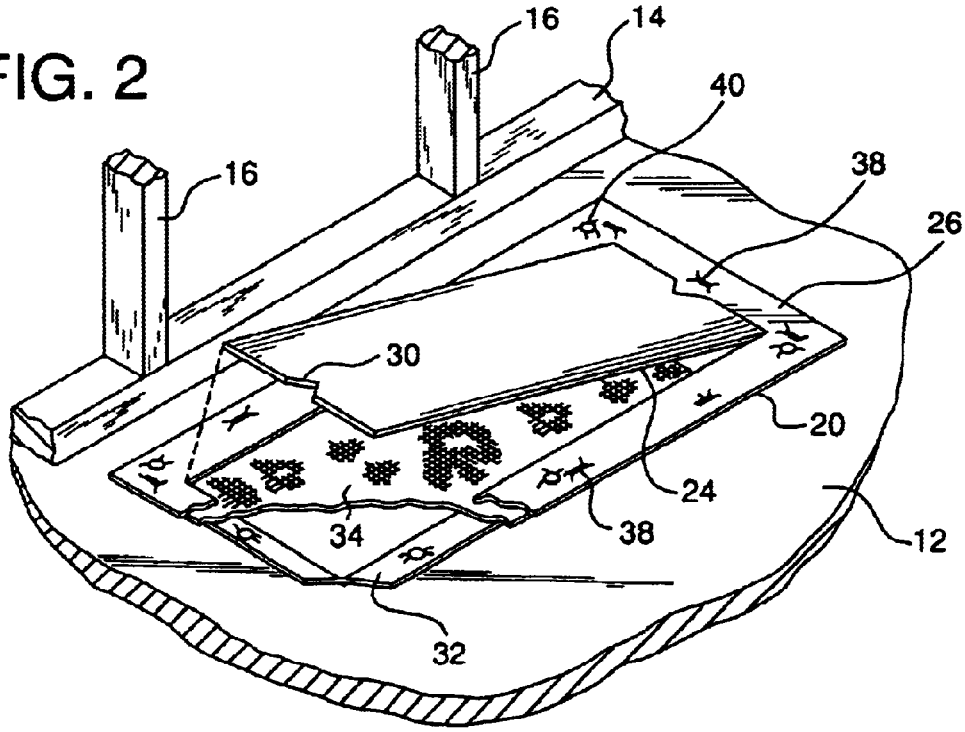
FIG. 2 is a view in perspective of the openable screened floor vent cover illustrating the removal of an insert surrounded by a cut in the board.
Figure 3:
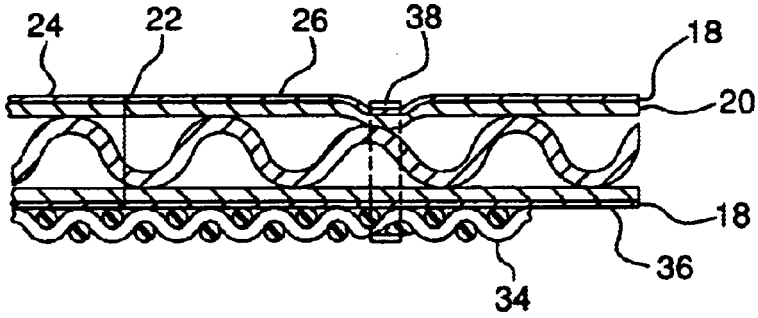
FIG. 3 is cross-sectional view taken along line 3—3 of FIG. 1.

As may be best seen from FIGS. 1, 2 and 3 taken together, the present invention is comprised of a board 20. Board 20 is provided with a length and a width larger than the vent to be covered. Board 20 may be constructed of any suitable rigid or semi-rigid material. In a presently preferred embodiment, board 20 may be constructed of relatively inexpensive cardboard. The board 20 may be metalized or covered with a metallic foil 18 as shown in FIG. 3. Foil 18 may be aluminum or other suitable metal. Alternatively, board 20 may be covered with other suitable coverings, such as a synthetic plastic material which is impervious to moisture. However, metallic foil 18 is not necessary nor required. The cardboard with the metallic foil 18 is of the type that is commonly used in connection with duct work, such as that which is commercially available under the trademark "THERMOPAN, " from Thermo Manufacturing, Inc. located at 3709 Columbus Road NE, Canton, Ohio 44705.

As best illustrated in FIGS. 1 and 2, board 20 is provided with a cut 22 substantially in the shape of a floor vent to be covered, but in view of the structure and operation of the present invention, the cut need not correspond exactly to the shape of the vent. In fact board 20 and cut 22 could be substantially larger than the size of the vent without any adverse effect in the use and operation of the openable screened floor vent cover of the present invention. Furthermore, cut 22 could be smaller than the vent as long as board 20 is larger than the vent opening and is attachable to the subflooring such that one or more intervening elements (e.g. screen 34, described below) can be sandwiched between the board 20 and the subflooring. Cut 22 is preferably a fine cut wherein the portion of the board 24 within cut 22 may be frictionally retained within a peripheral portion 26 of board 20, but also easily removed. For convenience, the portion of the board within the cut 24 may be referred to herein as the insert portion. To aid in the removal of insert portion 24 from the remainder of board 20, cut 22 may be provided with an indent 28 to provide tab or indent 30 on insert 24. Tab or indent 30 makes it easier for a worker to get his fingernail, tool or other lifting means under an edge of insert 24 to remove it. Insert 24 may be removed to allow airflow from vent 32 to provide heating airflow or cooling airflow from the vent as may be desired. Heating airflow is often required, particularly in cooler climates during the fall, winter and spring seasons when dry wall is being finished. It may also be required for other reasons. Cooling airflow may be required in warm or hot climates. Once there is no longer a need for airflow from the vent, insert 24 may be replaced within periphery 26 of board 20.

As best illustrated in FIGS. 2 and 3, board 20 is provided with an airflow permeable debris barrier in the form of a screen 34 mounted to a first surface 36 of board 20. Screen 34 is secured to first surface 36 of periphery 26 by staples 38. However, it is understood that screen 34 may be mounted to first surface 36 of board 20 by any suitable means such as adhesive, rivets or other fastening means.

In use, openable screened floor vent cover 10 is mounted over the subflooring as illustrated in FIGS. 1 and 2 by nails 40. However, any suitable means of securing openable screened floor vent cover 10 over the vent 32 and subflooring 12 may be utilized including staples, tacks, roofing nails, screws or the like. Once openable screened floor vent cover 10 is mounted over the subflooring 12 and vent 32, debris from the construction process, such as saw dust, wood chips, nails, vinyl and paper insulation removed from electrical wires, pieces of dry wall and the like are precluded from entering vent 32. When airflow is desired from the vent for various reasons, the portion of the board 24 within the cut 22 may be removed by inserting a fingernail, putty knife, screwdriver or the like into the cut and lifting insert 24 out from the periphery portion of the board 26 to enable airflow. As discussed above, indent or tab 30 in insert 24 may be helpful in this regard.

It is understood that insert tab 30 may be located at any suitable location. It is presently preferred on the shorter side of insert 24, but it could be positioned on the long side. Alternatively, tabs could be placed on all four sides or there could be multiple tabs on each side.

Even with insert 24 removed to allow airflow from the vent, screen 34 protects the vent opening by precluding anything from entering the vent other than dust or the very finest of debris. In other words, the screening 34 would still preclude nails, pieces of dry wall, wood chips, electrical insulation and other item from falling into the vent. Once there is no longer any need for airflow from vent 32, insert 24 may be reinserted within periphery 26 of the openable screened floor vent cover 10. Openable screened floor vent cover 10 may be removed after construction is complete. At this time openable screened floor vent cover 10 may be discarded as a disposable item or, if desired, may be reused on another construction job.

Figure 4:
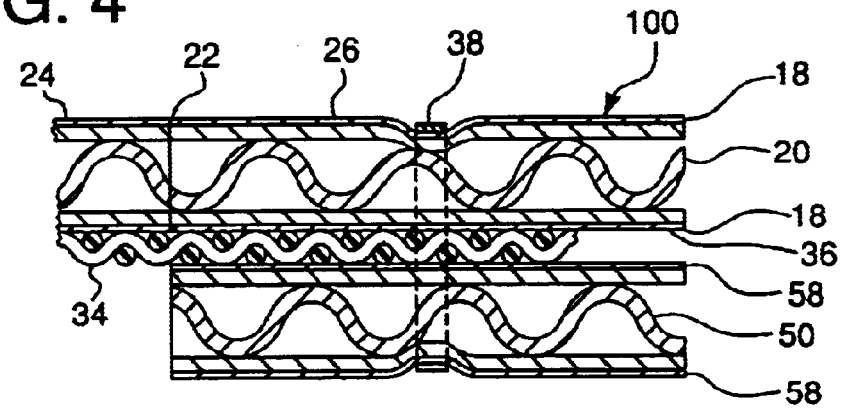
FIG. 4 is a cross-sectional view, corresponding to line 3—3 of FIG. 3 of another embodiment of the invention wherein the screening is sandwiched between the board and a board element.

Referring now to FIG. 4, there is shown another embodiment of the present invention wherein elements corresponding to those shown in FIGS. 1 through 3 are given the same reference numerals. In FIG. 4, openable screened floor vent cover 100 is provided with a second board element 50. Second board element 50 is shaped or formed or cut out to. surround the vent opening corresponding to cut 22. Second board element 50 is secured to the periphery 26 of first surface 36 of board 20 including the intervening portion of screen 34. As with respect to FIGS. 1 through 3, this may be secured by a staple 38, by rivets, adhesive or any other suitable fastening means. As illustrated in FIG. 4, second board element 50 would preferably include metallic foil layers 58. However, metallic foil layers 58 are not. necessary even if board 20 is provided with a foil or other covering. Further, board element 50 could be comprised of a different material, for example board 20 could be comprised of. cardboard and board element 50 could be comprised of a thin layer of wood. The provision of second board element 50 can provide additional rigidity for openable screened floor vent. cover 100 and can provide a cover for the free end of screen 34. However, if minimalization of cost is a prime criteria, second board element 50 is not necessary.

Figure 5:
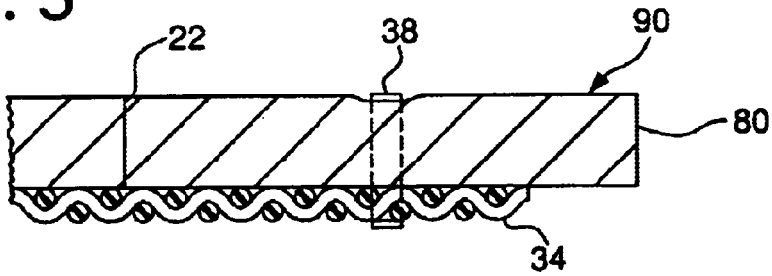
FIG. 5 is a cross-sectional view of the section corresponding to line 3—3 of FIG. 3 of another embodiment showing the board made of another material.

Referring now to FIG. 5, there is shown another embodiment of an openable screened floor vent cover 90 which is identical of that disclosed and described with respect to FIGS. 1 through 3, but it illustrates that the board may be made of other suitable materials including wood, composite manufactured materials or any other suitable material. The board in FIG. 5 is designated as 80 and the other elements are given the same numerals as ink FIGS. 1 through 3.

Figure 6A:
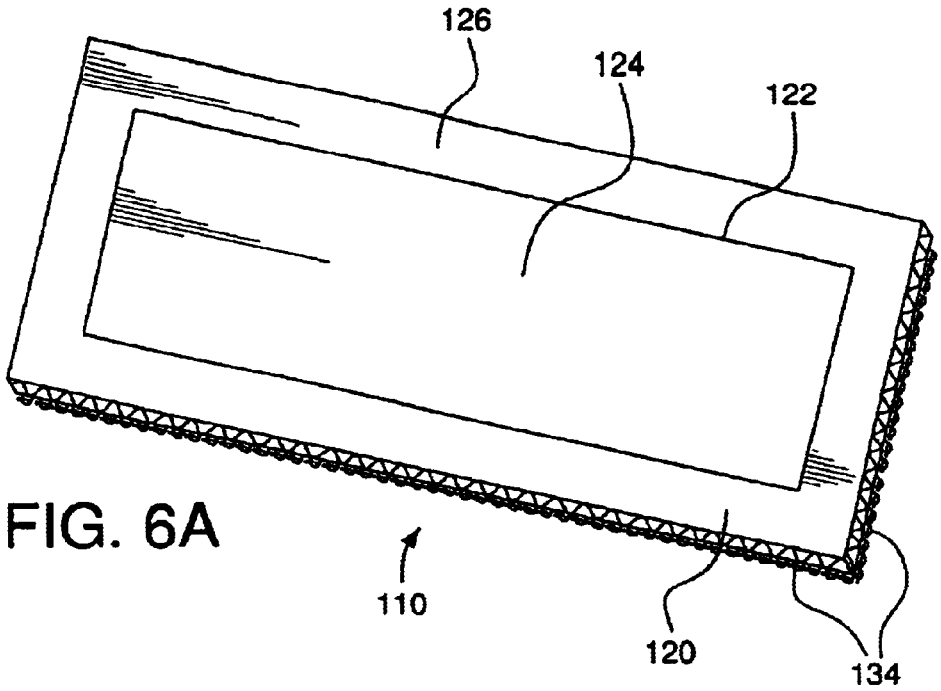
FIG. 6A is an isometric view of another embodiment of the vent cover according to the present invention.
Figure 6B:
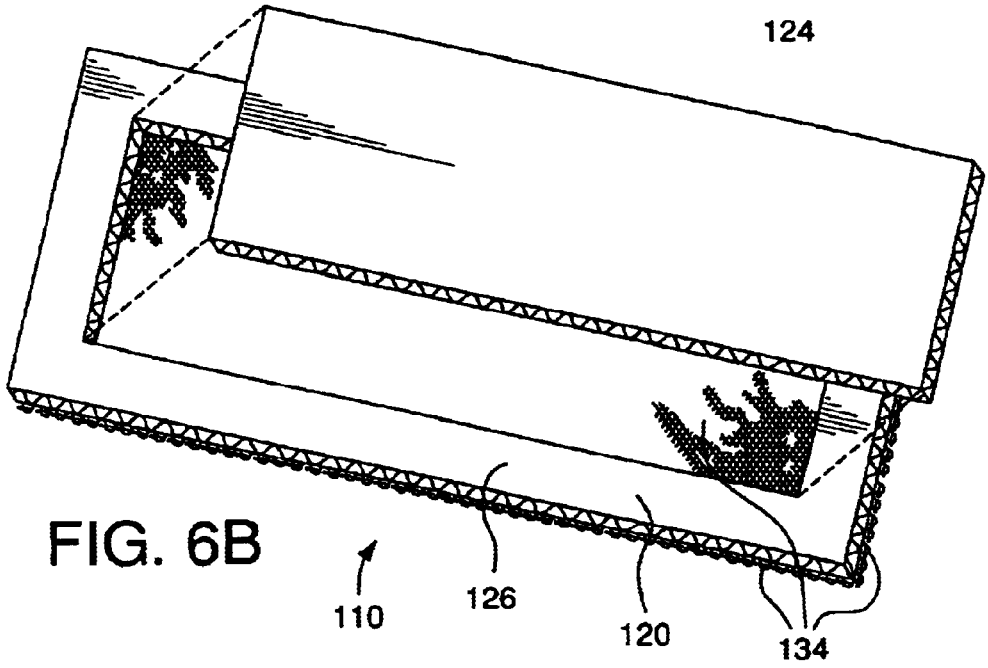
FIG. 6B is an isometric view of the vent cover of FIG. 6A with the insert portion removed.

FIGS. 6A and 6B show yet another embodiment of the present invention. In the openable vent cover 10 of FIGS. 6A and 6B, a fibrous material 134, such as thin burlap, loosely woven cloth or mesh, is attached to the board 120. The fibrous material 134 serves as the airflow permeable debris barrier, thereby performing a similar function as the screen 34 in FIGS. 1–5. Any fibrous material which allows sufficient airflow through it, while preventing the passage of significant solid debris, such as nails and the like, can be used as the airflow permeable debris barrier.

In the embodiment of FIGS. 6A and 6B, the board 120 is substantially the same as the board 20 shown in FIGS. 1–5. The board 120 may be cardboard, cardboard laminated with foil or any other suitable rigid or semi-rigid material, such as those described above. The board 120 is divided by a cut 122 substantially in the shape of a floor vent to be covered. Like the cut 22 of the above-described embodiments, the cut 122 need not correspond exactly to the shape of the vent. In fact, the board 120 and cut 122 could be substantially larger than the size of the vent without any adverse effect in the use and operation of the openable floor vent cover 110. Furthermore, cut 122 could be smaller than the vent as long as the board 120 is larger than the vent and is attachable to the subflooring such that one or more intervening elements (e.g. fibrous material 134) can be sandwiched therebetween.

Cut 122 is preferably a fine cut wherein the portion of the board within cut 122 (i.e. the insert portion 124) may be frictionally retained within a peripheral portion 126 of the board 120, but also easily removed. To aid in the removal of insert portion 124 from the peripheral portion 126, cut 122 may be provided with an indent (not shown) similar to indent 28 of the above-described embodiments.

The board 120 and airflow permeable debris barrier 134 can be attached to one another and mounted to subflooring surrounding a vent by any suitable means, including those described previously. Once mounted, insert portion 124 may be removed to allow airflow from the vent as shown in FIG. 6B, thereby providing heating airflow or cooling airflow from the vent as may be desired. Once there is no longer a need for airflow from the vent, insert 124 may be replaced within periphery 126 of the board 120.

Figure 7A:
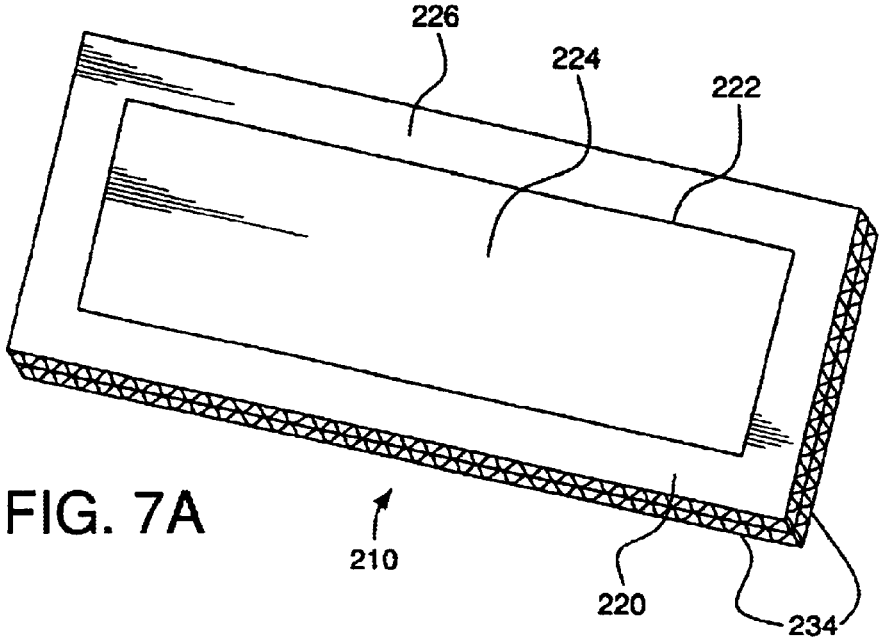
FIG. 7A is an isometric view of an embodiment of the present invention in which an openable vent cover is formed from components which are all of the same material.
Figure 7B:
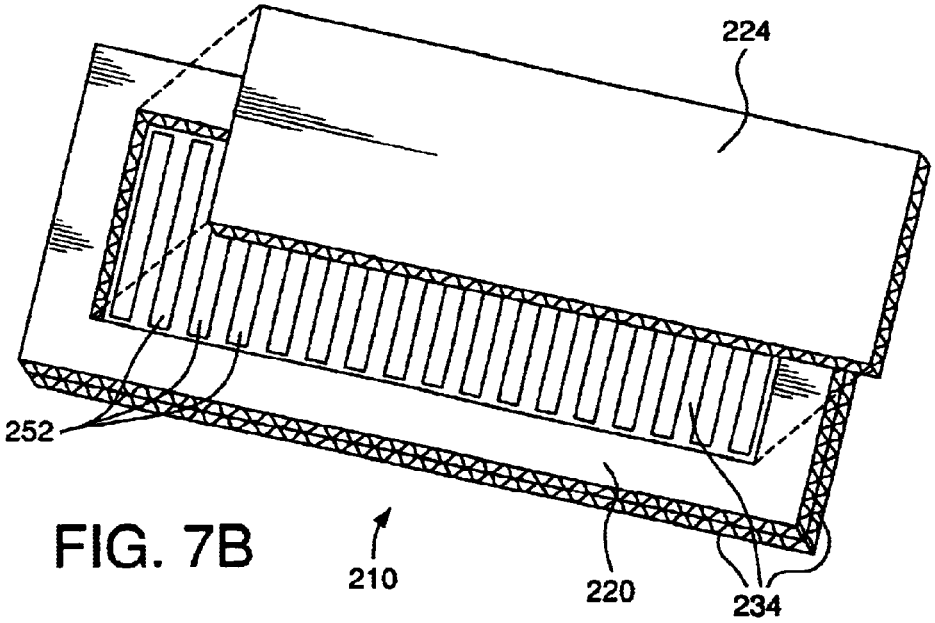
FIG. 7B is an isometric view of the vent cover of FIG. 7A with the insert portion removed.

FIGS. 7A and 7B show an embodiment of a vent cover 210 in which a board 220 and an airflow permeable debris barrier 234 are made from the same material, preferably cardboard. The material can also be cardboard laminated with foil or any other suitable rigid or semi-rigid material, such as those described above. In the embodiment of FIGS. 7A and 7B, the airflow permeable debris barrier is a perforated board 234, which has been provided with perforations 252 by punching, cutting, scoring or otherwise forming them therein.

The embodiment shown in FIGS. 7A and 7B can be assembled by attaching the first board 220 to the perforated board 234 using a method similar to those for the embodiments shown in FIGS. 1–5. The first board 220, which is similar to the board 20 and board 120 in FIGS. 1–6, is provided with a cut 222 substantially in the shape of a floor vent to be covered. As shown in FIG. 7A, cut 222 is preferably a fine cut dividing the board into an insert portion 224 within cut 222, which is left frictionally retained within a peripheral portion 226. The cut 222 is similar to the cuts 22 and 122, which have already been fully described with regard to the embodiments shown in FIGS. 1–6, in other respects as well. Like the analogous insert portions 24 and 124, the insert portion 224 can be easily removed as shown in FIG. 7B.

The perforated board 234 is shown in the Figures with perforations 252 in the form of relatively large parallel slits for clarity in describing the invention. However, in practice, it is preferred that the perforations be relatively small, such as a quarter of an inch wide or less. A small perforation size will minimize the size of debris that can fall into the vent to be covered by vent cover 210. The perforation 252 may be formed in a variety of alternative shapes and configurations, such as round holes or small "X" shaped cuts. The range of suitable shapes and arrangements for the perforations 252 is, in fact, quite diverse. It is preferred that the perforations 252 be completely removed from the perforated board 234 when the board is formed. However, the perforations 252 could alternatively be formed by lines of weakness for a user to remove before or at the time of installation.

Figure 8:
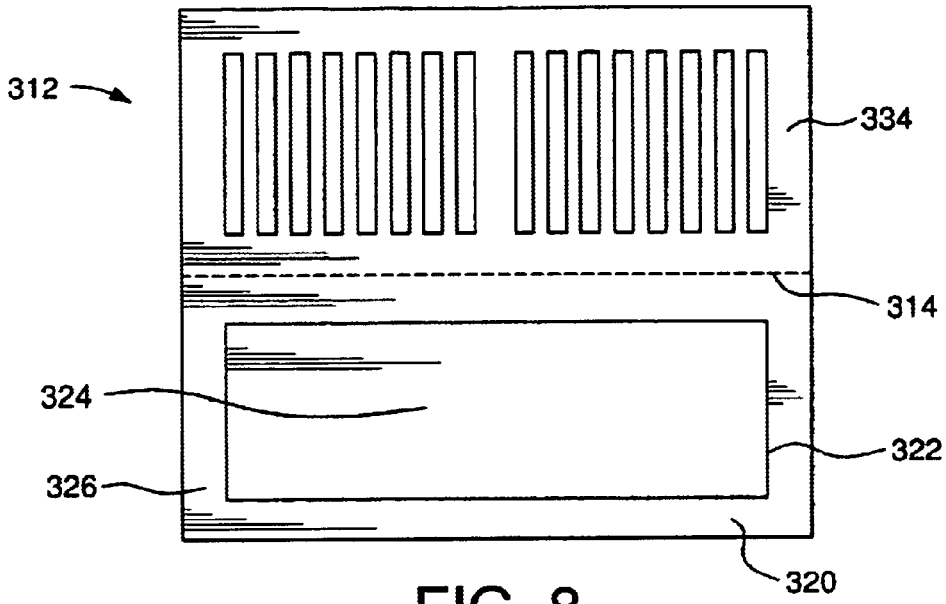
FIG. 8 is a plan view of a blank for forming a unitary embodiment of an openable vent cover similar to that of FIGS. 7A and 7B.
Figure 9:
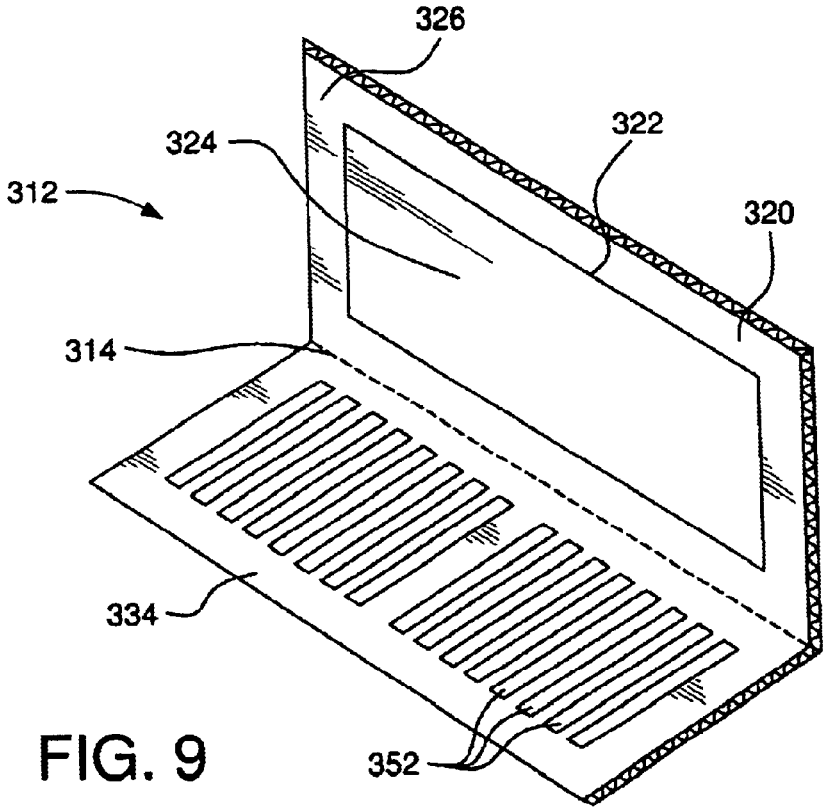
FIG. 9 is a perspective view of the blank of FIG. 8 partially folded.

FIGS. 8 and 9 show a unitary embodiment of an openable vent cover according to the present invention. According to the unitary embodiment, an openable vent cover very similar to that of FIGS. 7A and 7B can be made from a single board, such as a cardboard blank 312, shown in FIG. 8. The blank 312 is provided with a fold line 314, which divides the board into a first half 334 and a second half 320. A series of perforations 352 are punched, cut, scored or otherwise formed in the first half 334. The perforations 352 are shown as relatively large parallel slits in the Figures for clarity. However, like the perforations 252 of the embodiment of FIG. 7, it is preferred that the perforations 352 be relatively small, such as a quarter of an inch wide or less. A small perforation size will minimize the size of debris that can fall into the vent once covered with a fully assembled unitary cover. Of course, the perforations 352 may be formed in a variety of alternative shapes and configurations as described above. It is preferred that the perforations 352 be completely remove d from the first half 334 when the blank 312 is formed. However, in practice the perforations 352 could be formed by lines of weakness for a user to remove before or at the time of installation.

The second half 320 of the blank 312 is similar to the board 20 described above with reference to the embodiments of FIGS. 1–6. A similarity is the provision of a cut 322 substantially in the shape of a floor vent to be covered. Like the cut 22 of the other embodiments, the cut 322 need not correspond exactly to the shape of the vent. In fact the second half 320 and cut 322 could be substantially larger than the size of the vent without any adverse effect in the use and operation of the openable floor vent cover 310 of the unitary embodiment. Further more, cut 322 could be smaller than the vent as long as the second half 320 is larger than the vent and is attachable to the subflooring such that on e or more intervening elements (e.g. first half 334) can be sandwiched therebetween. Cut 322 is preferably a fine cut wherein the portion of the board 324 within cut 322 may be frictionally retained within a peripheral portion 326 of the second half 320, but also easily removed. Like the analogous element in the above embodiments, the portion of the board within the cut 322 may be referred to herein as the insert portion 324. To aid in the removal of insert portion 324 from the peripheral portion 326 of the second half 320, cut 322 may be provided with an indent (not shown) similar to that of indent 28 of the first embodiment. Insert portion 324 may be removed to allow airflow from a vent, over which the vent cover h as been attached, to provide heating airflow or cooling airflow from the vent as maybe desired. Once there is no longer a need for airflow from the vent, insert 324 may be replaced within periphery 326 of the second half 320.

To assemble a vent cover from the blank 312, an assembler punches out and removes the perforations 352 in the first half 334. The assembler then folds the blank 312 along fold line 314, as shown in FIG. 9, and juxtaposes the first half 334 and the second half 320. The peripheral portion 326 of the second half 320 is then attached to the first half 334 by staples, adhesive, rivets or any other suitable means. Removal of the perforations 352, as well as the folding, juxtaposing and attaching steps can be performed when the blank 312 is manufactured or otherwise before it is provided to the end user. Alternatively the blank can be provided to the end user unfolded, leaving the user to perform these steps, thereby saving costs in mass production.

In the event that the user is left to perform the assembly, it is also possible to reduce material cost by attaching the peripheral portion 326 of the second half 320 to the first half 334 concurrently with the mounting of the openable vent cover to the subfloor surrounding the vent. In that case, the user folds the blank 312 and attaches the peripheral portion 326 and the first half 334 while mounting the cover to the subfloor using staples, tacks, roofing nails, screws or the like in a single step. Thus, the peripheral portion 326 of the second half 320 and first half 334 are both attached to the floor or subfloor surrounding the vent with a single set of fasteners. The step of first attaching the peripheral portion 326 to the first half 334, and the material required to do it, can be dispensed with. The assembled openable vent cover according to the unitary embodiment is similar to that shown in FIGS. 7A and 7B except that elements 320 and 334 are connected by a fold line at an edge formed by fold line 314.

Once installed over a vent opening, the unitary embodiment works in a similar manner as the embodiments previously described. The insert portion 324 may be left in place until a supply of conditioned air is desired from the vent. When the conditioned air is desired, the insert portion 324 may be removed to allow airflow from the vent to pass through the perforations 352 of the first half 334, which acts as the airflow permeable debris barrier. Thus, heating airflow or cooling airflow from the vent may be introduced as desired. Once there is no longer a need for airflow from the vent, insert 324 may be replaced within periphery 326 of the second half 320. Otherwise, the insert portion 324 may be discarded.

It should also be understood that the present invention can take the form of additional embodiments that combine features of the various embodiments described herein. As such, the present invention may be embodied in other specific forms without departing from the spirit or essential attributes thereof and, accordingly, reference should be made to the appended claims, rather than to the foregoing specification as indicating the scope of the invention.

We claim:

1. A cover for a conditioned air supply vent in the floor of a building under construction, the cover comprising:

a unitary board having a length arid a width greater than the conditioned air supply vent opening to be covered, the board having a fold line that divides the board into a first half and a second half, the first half having a plurality of perforations therein, and the second half comprising a peripheral portion adapted to be secured to a subfloor surrounding the vent and having an opening therein, and a removable insert portion substantially in the shape and size of the opening in the peripheral portion for covering the vent opening.

2. The cover of claim 1 wherein said board is cardboard.

3. The cover of claim 1 wherein the unitary board is folded at the fold line and the peripheral portion is attached to the first half by fasteners.

4. The cover of claim 1 wherein the unitary board is folded at the fold line, placed adjacent the conditioned air supply vent, and the peripheral portion is attached to the first half and the floor or subfloor adjacent the conditioned air supply vent by a single set of fasteners.

5. The cover of claim 1 wherein the insert portion of said board, after it has been removed, may be replaced to close said vent as desired.

6. A disposable cover for a conditioned air supply vent opening in the floor of a building under construction, the cover comprising:

(a) a first board having a length and a width larger than the vent opening to be covered, the board having a cut that divides the board into (1) a peripheral portion adapted to be secured to a subfloor surrounding the vent and having an opening therein, and (2) a removable insert portion substantially in the shape and size of the opening in the peripheral portion for covering the vent opening; and (b) an airflow permeable debris barrier secured to the peripheral portion and positioned across the opening in the peripheral portion.

7. The cover of claim 6 wherein the airflow permeable debris barrier comprises a perforated board.

8. The cover of claim 7 wherein the perforated board is of unitary construction with the first board.

9. The cover of claim 8 wherein the perforated board and the first board are attached at a fold line.

10. A vent cover comprising:

a board divided by a cut into a central insert portion and a peripheral portion, the central insert portion being frictionally but removably retained within the peripheral portion;

the insert portion being sized and shaped to allow airflow through the vent when the peripheral portion is attached to a subfloor surrounding the vent and the insert portion is removed from the peripheral portion; and an airflow permeable debris barrier juxtaposed with the insert portion and attached to the peripheral portion.

11. The cover of claim 10 wherein the airflow permeable debris barrier comprises a perforated board portion.

12. The cover of claim 11 wherein the perforated board portion, the insert portion and the peripheral portion are of unitary construction from the board, and wherein the board further comprises a fold line, the fold line separating the insert and peripheral portions from the perforated portion.

13. A method of preventing debris from entering air ducts during construction of a building, the method comprising:

providing a floor vent cover comprising a board having a central insert portion removably engaged with a peripheral portion and an airflow permeable debris barrier attached to the peripheral portion;

mounting the floor vent cover over a vent and subflooring; and removing the insert portion when airflow from the vent is desired.

14. The method of claim 13 wherein the providing step comprises the steps of supplying a board divided by a fold line into a perforated first portion comprising the airflow permeable debris barrier and a second portion having the central insert portion removably engaged with the peripheral portion, folding the board at the fold line, and juxtaposing the perforated first portion and the second portion.

15. The method of claim 14 wherein the mounting step comprises attaching the peripheral portion to the perforated portion and the subfloor with a single set of fasteners.

16. The method of claim 14 further comprising the step of attaching the peripheral portion to the perforated portion prior to the mounting step.

* * * * *